US005591935A

United States Patent [19]

Shamblen et al.

[11] Patent Number: 5,591,935

[45] Date of Patent: Jan. 7, 1997

[54] SHOCK SENSING DUAL MODE WARHEAD

[75] Inventors: Morley C. Shamblen, La Plata; Martin T. Walchak, Brookville; Louis Richmond, Bethesda, all of Md.

[73] Assignee: The United States of America as represented by the Secretary of the Navy, Washington, D.C.

[21] Appl. No.: 186,888

[22] Filed: Aug. 27, 1980

[51] Int. Cl.[6] ..... F42B 13/00; F42C 9/14; F42C 1/08

[52] U.S. Cl. ..... 102/500; 102/216; 102/269; 102/275

[58] Field of Search ..... 102/265, 266, 102/269, 272, 273, 216, 275, 499, 500

[56] References Cited

U.S. PATENT DOCUMENTS

| | | | |
|---|---|---|---|
| 1,105,848 | 8/1914 | Semple | 102/265 |
| 1,347,716 | 7/1920 | Semple | 102/265 |
| 1,531,717 | 3/1925 | Rémondy | 102/265 |
| 3,372,642 | 3/1968 | Brothers | 102/216 |
| 3,633,510 | 1/1972 | Bernardin | 102/265 X |
| 3,786,754 | 1/1974 | Donahue et al. | 102/238 |
| 3,808,972 | 5/1974 | Cammack et al. | 102/265 X |
| 3,888,182 | 6/1975 | Breed | 102/272 |
| 4,237,788 | 12/1980 | Hagen | 102/273 X |

FOREIGN PATENT DOCUMENTS

| | | | |
|---|---|---|---|
| 1194408 | 5/1959 | France | 102/265 |

*Primary Examiner*—Charles T. Jordan
*Attorney, Agent, or Firm*—James B. Bechtel, Esq.

[57] ABSTRACT

A shock sensing dual mode warhead is provided for use against both soft and hard targets and is capable of sensing which type of target has been struck. The warhead comprises a casing made of a ductile material containing an explosive charge and a fuze assembly. The ductile warhead casing will mushroom upon striking a hard target while still confining the explosive. Proper ductility and confinement are necessary for fuze shock sensing. The fuze assembly contains a pair of parallel firing trains, one initiated only by dynamic pressure caused high impact deceleration and one initiated by low impact deceleration. The firing train actuated by high impact deceleration senses dynamic pressure transmitted, during deformation of the warhead, through the explosive filler which is employed as a fuzing signature. The firing train actuated by low impact deceleration contains a pyrotechnic delay to allow penetration of soft targets.

7 Claims, 3 Drawing Sheets

FIG. 3
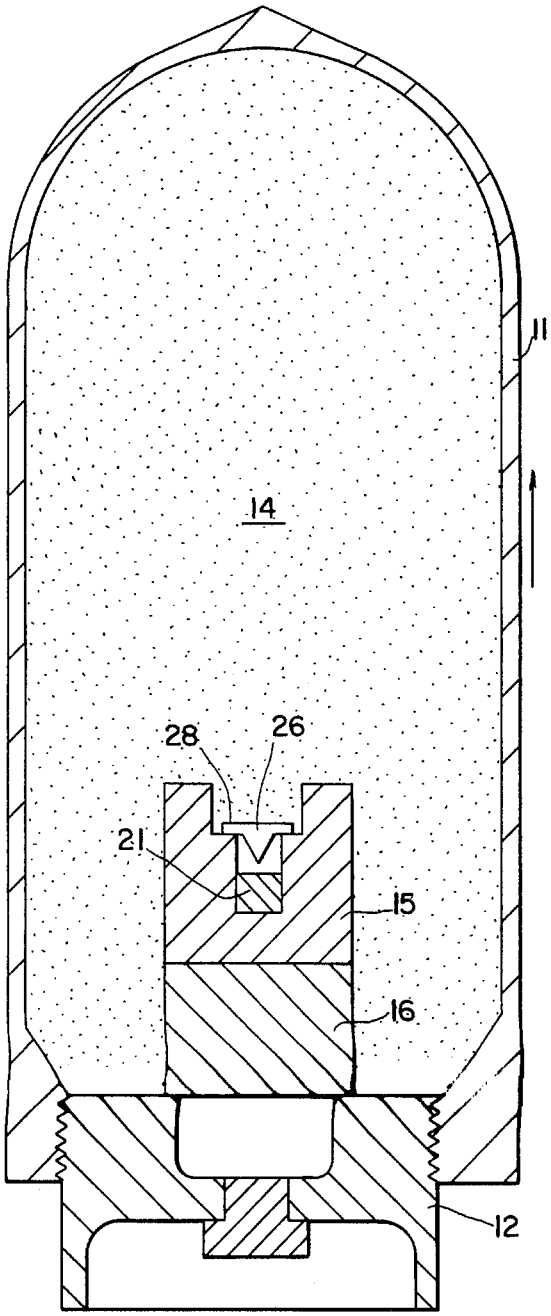
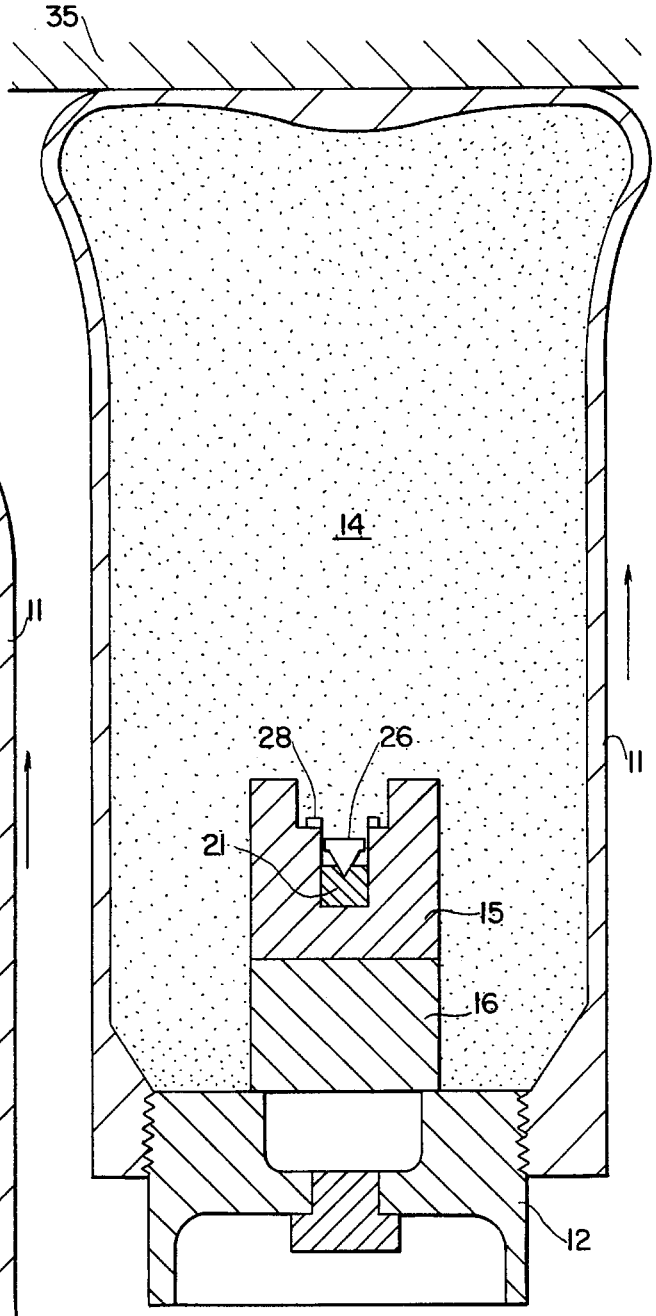
FIG. 4

SHOCK SENSING DUAL MODE WARHEAD

BACKGROUND OF THE INVENTION

1. Field of the Invention

This invention relates generally to projectile and missile warheads, and more particularly to a dual warhead which may be used to defeat a range of infantry targets which previously required different warheads for defeat.

2. Description of the Prior Art

In the past there has been no single warhead small enough to be both man-portable and shoulder-launched which was capable of defeating both soft targets such as sandbag-timber or sandbag-concrete bunkers and hard targets such as masonry or reinforced concrete bunkers. Several different warhead types were needed to defeat such a target spectrum. A man-portable, hard target warhead striking a sandbag-timber or sandbag-concrete bunker would detonate on the surface and simply blow a lot of sand about. On the other hand, a soft target warhead containing a pyrotechnic delay to allow penetration, would fragment or rupture before the delay had timed out upon striking a hard target thereby releasing some explosive and reducing its effectiveness. It would therefore be highly desirable to provide a single warhead, operable in two modes, and effective against both soft and hard targets. One earlier solution to this problem is described in copending application Ser. No. 86/181,303, filed Aug. 25, 1980, in which one of the inventors herein is a co-inventor. The warhead described in the aforementioned copending application, however, was limited in operation to target strike obliquities on the order of 45°.

SUMMARY OF THE INVENTION

The present invention obviates the aforementioned disadvantages by providing a shock and pressure sensing dual mode warhead effective against the entire spectrum of infantry targets and operable even at high angles of target strike obliquity. The warhead comprises a casing made of a ductile material containing a malleable yet structurally stiff explosive charge and a fuze assembly and booster. The fuze assembly contains, in addition to the usual safing and arming mechanism, a pair of parallel firing trains initiated by the shock and pressure of the impact deceleration. One of these firing trains is responsive to low impact decelerations and incorporates therein a pyrotechnic delay to enable substantial penetration of soft targets. The other firing train is designed to be responsive only to the dynamic pressure caused by high impact declerations encountered when striking hard targets. This firing train senses impact with a hard target by responding to dynamic pressure transmitted through a warhead explosive filler which is employed as a fuzing signature. This pressure is caused by deformation, mushrooming, or crush-up of the warhead upon impact. The structural stiffness of the explosive charge facilitates transmittal of the deceleration forces to the fuzing assembly and the ductility of the casing enables the casing to confine the explosive filler while mushrooming upon impact with the hard target until the explosive is detonated.

STATEMENT OF THE OBJECTS OF THE INVENTION

It is a primary object of this invention to provide a warhead which may be used to defeat a wide range of infantry targets.

It is another object of this invention to provide a dual mode warhead which is effective against both soft and hard targets.

It is a further object of this invention to provide a dual mode warhead capable of sensing whether it has struck a soft or hard target and then functioning accordingly.

It is yet another object of this invention to provide a dual mode warhead which may be employed in projectiles as well as various types of missiles.

It is yet a further object of this invention to provide a shock sensing dual mode warhead which utilizes dynamic pressure within the warhead explosive as a fuzing signature upon impact with a hard target.

BRIEF DESCRIPTION OF THE DRAWINGS

Other objectives, advantages and novel features of the invention will become readily apparent upon consideration of the following detailed description when read in conjunction with the accompanying drawings wherein:

FIG. 3 is a sectional view of the warhead schematically illustrating the principal elements of the fuzing assembly which responds to high impact decelerations;

FIG. 4 is a view similar to FIG. 3 and illustrates the beginning of operation of the high impact deceleration firing train initiated by dynamic pressure within the warhead explosive filler.

DESCRIPTION OF THE PREFERRED EMBODIMENT

Figure 1:
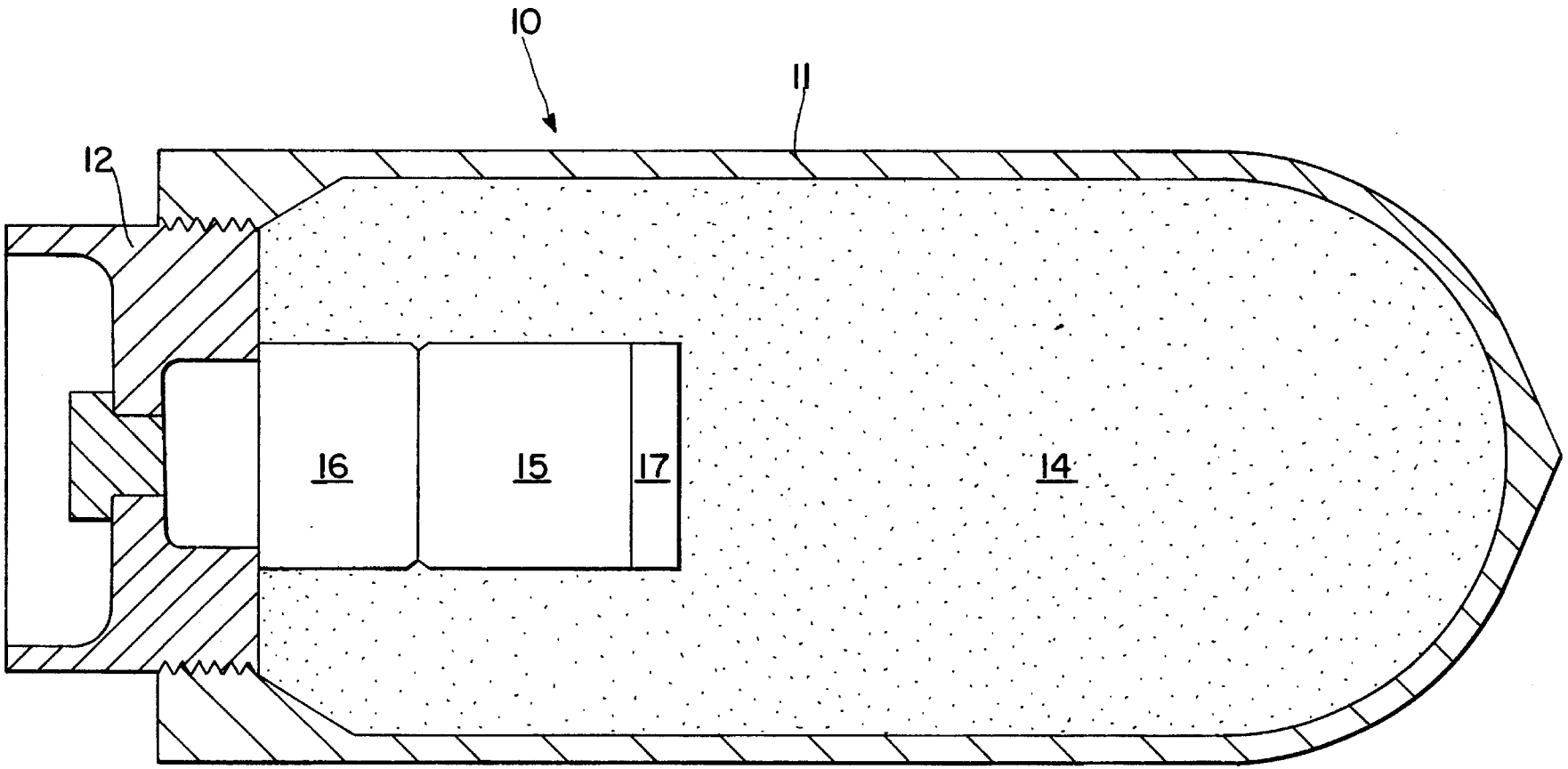
FIG. 1 is a sectional view of the shock sensing dual mode warhead of the present invention illustrating the principal components thereof.

Attention is now directed to the drawings, wherein like numerals of reference designate like parts throughout these several views, and more particularly to FIG. 1 wherein there is illustrated a shock sensing dual mode warhead designated generally by the reference numeral 10. The warhead 10 comprises a casing or body 11, which is substantially a right-circular cylinder having a hemispheric nose, and a base closure 12. The casing 11 is fabricated of a strong yet ductile material such as aluminum or steel. The strength permits substantial penetration of a soft target with little deformation until detonation by a time delay fuze. The ductility permits the casing to mushroom against a hard target while still confining the explosive charge, and thus maintaining the dynamic pressure within the explosive charge, until detonation by the fast firing train. A conical projection on the hemispheric nose of the casing 11 enhances the aerodynamic and sand penetration characteristics of the dual mode warhead. The base closure 12 is an adapter for connecting the warhead 10 to some propulsion system, e.g., rocket motor or recoilless rifle launcher (not shown), or it may be a simple plug depending on the weapons system using the warhead. The casing or body 11 is filled with a structurally stiff explosive charge 14 for transmitting the deceleration shock of target impact, and by internal dynamic pressure, to the fuze with minimum attentuation. Composition A-3 with 30% (by weight) powdered aluminum meets this requirement, as well as being an extremely energetic explosive. A fuze assembly 15 and booster 16 are fixed to the base closure 12 for detonating the explosive charge 14. A rubber pad 17 is fixed to one end of the fuze assembly 15 for uniformly applying and amplifying dynamic pressure within the explosive charge 14 to the fuze assembly 15.

Figure 2:
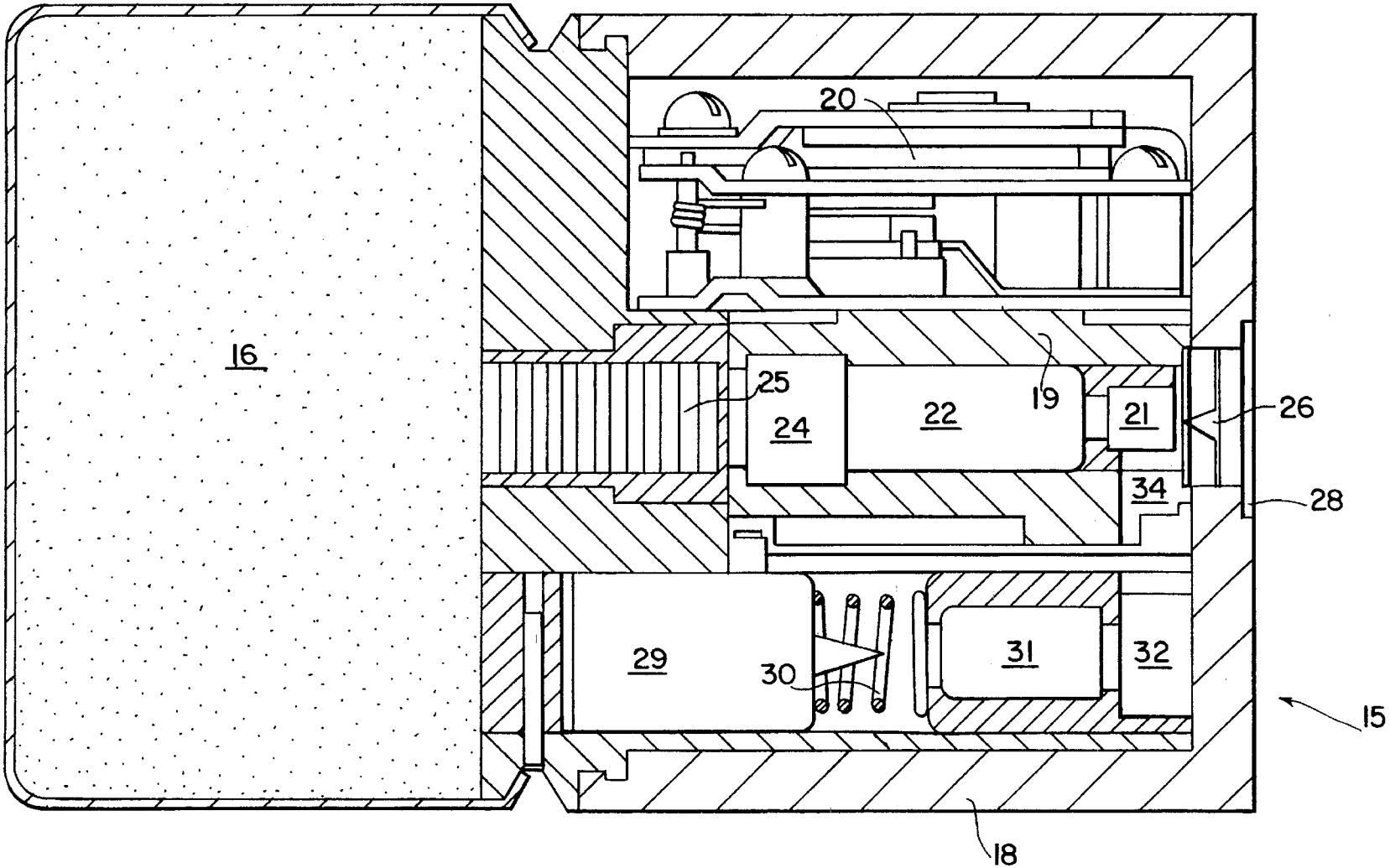
FIG. 2 is a sectional view of the fuzing assembly illustrating the principal features thereof.

Attention now is directed to FIG. 2 wherein the fuze assembly is illustrated in greater detail. The fuze assembly 15 comprises a shield 18 having a rotor 19 disposed therein. The rotor 19 is movable from a safe to an armed position by means of an arming mechanism 20. The arming mechanism 20 may be any of various safing and arming mechanisms well known to those skilled in the art, such as the 3-leaf mechanism, and will not be described in any further detail. The rotor 19 contains an explosive train comprising a stab primer 21, a delay element 22, a detonator 24 and an explosive lead 25. A pressure actuated firing pin 26, having an integral flange 28, is disposed within a counter-bored recess formed in one end of the shield 18 adjacent the stab primer 21. The elements 26, 21, 22, 24 and 25 comprise the high g pressure sensing firing train and will operate upon warhead impact with hard targets.

An intertially actuated firing pin 29 is disposed within the shield 18 and is normally biased to the position shown in FIG. 2 by means of a compression spring 30. The firing pin 29 is axially aligned with a stab delay primer 31 and a primer 32. The rotor 19 is provided with a blow-thru hole 34 which permits access of a detonation wave from the primer 32 to the primer 21 when the rotor 19 is disposed in its armed position. The elements 29, 31, 32, 21, 22, 24 and 25 comprise the low g firing train and will operate upon warhead impact with soft targets.

OPERATION

In order that a better understanding of the invention might be had, its mode of operation will now be described.

The dual mode warhead will normally have an impact velocity on the order of 250 to 3,000 ft/sec. If the round impacts a soft target, such as a sandbag-timber or a sandbag-concrete bunker, the round will penetrate to a depth of 3 to 4 feet or greater. The fuze will sense, by the magnitude of the initial deceleration, that the round has struck a soft target. The sensing is accomplished as follows. Since the warhead is striking a soft target, there will be little or no deformation of the casing and hence little dynamic pressure within the explosive charge. Thus, the firing pin 26 will not initiate the high g firing train. However, the firing pin 29 will be urged forward due to its inertia compressing the spring 30 and initiating the stab delay primer 31. The primer 32, primer 21, delay elements 22, detonator 24, explosive lead 25, booster 16 and explosive charge 14 are then successively initiated. The time delay in the low g firing train allows sufficient time for substantial penetration of a soft target prior to detonation of the round. Test firings of dual mode warheads wherein the low g firing train included a 15 to 50 millisecond delay and was initiated by an impact deceleration of not more than 100 to 1,000 g against designated sandbag-timber bunkers have demonstrated these warheads to be highly effective.

If the round impacts a hard target, such as a reinforced concrete or masonry target, the casing will crush in a general mushroom shape, as illustrated, in FIG. 4, with the high g firing train functioning in about 0.5 milliseconds. The signature used to sense hard target impact is the dynamic pressure transmitted through the warhead explosive filler as the warhead begins to crush upon impact with the target. Prior to target strike, the warhead 10 appears substantially as schematically illustrated in FIG. 3. When a hard target is struck, the mushrooming illustrated in FIG. 4 reduces the internal volume of the casing 11 causing high dynamic pressures within the explosive filler 14. The internal dynamic pressure of the explosive 14 is applied through the rubber pad 17 (FIG. 1) to the firing pin 26. When the dynamic pressure exceeds the design value, the flange 28 yields or fails, and the firing pin 26 then strikes and initiates the primer 21. The delay element 22, detonator 24, explosive lead 25, booster 16 and explosive charge 14 are then successively detonated. Upon target impact, the low g firing train will also have been initiated. However, the primer 21 will have been initiated by the firing pin 26 well before the stab delay primer 31 has timed out and thus the low g firing train, though initiated, has no effect on the high g operation.

Tests have indicated that the maximum dynamic pressure sensed by the fuze on impact with soft targets is less than 400 psi. Thus the warhead will retain substantially the configuration schematically in FIG. 3 with the flange 28 unfailed and the firing pin 26 remaining away from the primer 21. The warhead will then be detonated by the low g firing train after appropriate delay to allow penetration. Tests have also indicated that on hard target impact, peak dynamic pressure within the explosive filler 14 ranges from about 15,000 to 60,000 psi, depending on the angle of impact. The firing pin 26 and integral flange 28 are designed so that a pressure of at least 5,000 psi must be applied to the face of the fuze through the rubber pad 17 to drive the firing pin 26 into the primer 21. This level of sensitivity assures that the firing pin will not be moved by setback forces acting on the fuze or high explosive filler, or by pressure or setforward forces acting on the fuze during impact with soft targets.

Manifestly the present invention possesses numerous advantages not found in prior art devices. One advantage of the unique explosive pressure sensing warhead disclosed herein is that only the proper actions of the warhead (i.e., mushrooming, deformation or crushing) can provide sufficient pressure to activate the fuze. This insures that the desired function only occurs when the warhead impacts a target of sufficient strength to cause warhead deformation. Tests have shown that significant and sufficiently high explosive filler dynamic pressures are generated at all angles of impact up to 60° of obliquity or less. This dual mode fuze employs two distinct and different environments for fuze functioning (1) impact deceleration is employed to fire a simple inertial low g firing pin into a long delay detonator to provide the high explosive delay (HED) mode of operation or a possible self-destruct feature and (2) the explosive filler dynamic pressure generated during warhead mushrooming or crushing is employed to activate the high g firing pin to provide the high explosive plastic (HEP) mode of operation.

Obviously many modifications and variations of the present invention are possible in the light of the above teachings and will readily occur to those skilled in the art. It is therefore to be understood that within the scope of the appended claims the invention may be practiced otherwise than as specifically described.

What is claimed is:

1. A shock sensing dual mode warhead for use against both soft and hard targets and capable of sensing which type of target has been struck comprising:

a hollow casing formed of a strong ductile material;

a base closure for closing the rearward end of said casing;

a structurally-stiff explosive charge filling the interior of said casing;

a booster mounted on said base closure and disposed within said explosive charge for detonating said explosive; and a shock-sensing fuze assembly mounted on said booster for initiating said booster upon impact with a target, said fuze assembly comprising:

a low g inertial firing train responsive to low impact deceleration for initiating said booster upon impact with a soft target, said low g firing train including a time delay element to permit substantial penetration of the target before detonation of said explosive charge; and a high g firing train responsive to dynamic pressure within said explosive charge caused by high impact deceleration for initiating said booster upon impact with a hard target, the ductility of said casing allowing said casing to mushroom without fragmenting upon impact with a hard target thereby disposing more of said explosive charge closer to the surface of said target prior to detonation of said explosive charge whereby the blast effectiveness is increased.

2. A warhead as defined in claim 1 wherein said high g firing train comprises:

a firing pin mounted in said fuze assembly and movable in response to dynamic pressure within said explosive charge;

a flange formed integral with said firing pin normally restraining movement of said firing pin and adapted to yield or fail in response to high dynamic pressure within said explosive charge upon hard target impact and thus allow movement of said firing pin;

a primer within said fuze assembly adapted to be initiated by said firing pin upon hard target impact; and a detonator fired by said primer for initiating said booster to detonate said explosive charge.

3. A warhead as defined in claim 1 wherein said high g firing train functions in about 0.5 milliseconds and is operable only when dynamic pressure within said explosive charge exceeds 5,000 psi.

4. A warhead as defined in claim 1 wherein said low g firing train comprises:

a low g inertial element;

a low g compression spring normally biasing said low g inertial element rearwardly;

a low g primer adapted to be initiated by forward movement of said low g inertial element upon soft target impact;

a pyrotechnic delay element initiated by said primer for allowing target penetration; and a detonator fired by said delay element for initiating said booster to detonate said explosive charge.

5. A warhead as defined in claim 4 wherein said high g firing train comprises:

a firing pin mounted in said fuze assembly and movable in response to high dynamic pressure within said explosive charge;

a flange formed integral with said firing pin normally restraining movement of said firing pin and adapted to yield or fail in response to high dynamic pressure within said explosive charge upon hard target impact and thus allow movement of said firing pin;

a primer within said fuze assembly adapted to be initiated by said firing pin upon hard target impact; and a detonator fired by said primer for initiating said booster to detonate said explosive charge.

6. A warhead as defined in claim 1 wherein said low g firing train incorporates a time delay of approximately 15 to 50 milliseconds and is operable when subject to an impact deceleration on the order of 100 to 1,000 g.

7. A warhead as defined in claim 6 wherein said high g firing train functions in about 0.5 milliseconds and is operable only when dynamic pressure within said explosive charge exceeds 5,000 psi.

* * * * *